United States Patent [19]

Kondziolka et al.

[11] Patent Number: 4,885,700

[45] **Date of Patent: * Dec. 5, 1989**

[54] COMPUTER-CONTROLLED METHOD AND APPARATUS FOR MAKING BINGO CARDS

[75] Inventors: Stanley Kondziolka, Markham; Henry Klein, Thornhill, both of Canada

[73] Assignee: Demco Bingo Inc., Thornhill, Canada

[ * ] Notice: The portion of the term of this patent subsequent to Nov. 21, 2006 has been disclaimed.

[21] Appl. No.: 165,183

[22] Filed: Mar. 7, 1988

Related U.S. Application Data

[63] Continuation-in-part of Ser. No. 823,187, Jan. 27, 1986, abandoned.

[30] Foreign Application Priority Data

Oct. 24, 1985 [CA] Canada ..... 493719

[51] Int. Cl.[4] ..... G06F 15/44; A63F 3/06

[52] U.S. Cl. ..... 364/519; 364/471; 273/269

[58] Field of Search ..... 270/1.1, 4, 18, 52; 273/236, 237, 269; 364/468, 469, 470, 471, 519, 523, 717, 518, 410

[56] References Cited

U.S. PATENT DOCUMENTS

| | | | |
|---|---|---|---|
| 3,653,026 | 3/1972 | Hurley | 273/237 |
| 3,790,768 | 2/1974 | Chevalier et al. | 364/717 |
| 3,822,876 | 7/1974 | Frain | 273/269 |
| 3,895,807 | 7/1975 | Friedman | 273/237 |
| 4,270,774 | 6/1981 | Barnes | 273/269 |
| 4,332,389 | 6/1982 | Loyd, Jr. et al. | 273/269 |
| 4,378,940 | 4/1983 | Gluz et al. | 273/269 |
| 4,398,708 | 8/1983 | Goldman et al. | 270/18 |
| 4,448,127 | 5/1984 | Frain | 270/1.1 |
| 4,455,025 | 6/1984 | Itkis | 273/269 |
| 4,475,157 | 10/1984 | Bolan | 364/410 |
| 4,527,798 | 7/1985 | Siekierski et al. | 364/717 |
| 4,611,811 | 9/1986 | Haase | 273/269 |

FOREIGN PATENT DOCUMENTS

| | | | |
|---|---|---|---|
| 1584477 | 2/1981 | United Kingdom | 364/717 |

*Primary Examiner*—Emanuel S. Kemeny
*Assistant Examiner*—Raymond J. Bayerl
*Attorney, Agent, or Firm*—Sim & McBurney

[57] ABSTRACT

The random number generating capability of a computer is used as a basis for producing sets of alphanumeric configurations for a plurality of bingo cards, and the comparator capability of the computer is utilized to eliminate duplication from among the plurality. A computer-controlled, high-speed graphics printer is used to print, on sheets of paper, bingo cards from among the plurality.

7 Claims, 2 Drawing Sheets

COMPUTER-CONTROLLED METHOD AND APPARATUS FOR MAKING BINGO CARDS

This is a continuation-in-part of U.S. patent application Ser. No. 823,187, filed on Jan. 27, 1986, now abandoned.

This invention relates generally to the production of bingo cards in the form of sheets, ready to be used in establishments where bingo is played.

BACKGROUND OF THIS INVENTION

The conventional method of producing sheets containing representations of bingo cards involves the formulation of the permutations of playable bingo cards, verification to avoid duplication, and standard offset printing equipment. In this conventional process, low unit costs can be maintained only by printing the bingo card representations on large paper sheets. Typically 36 cards would be printed on a sheet, consisting of 6 columns of 6 rows each. Naturally, in reduce to avoid card duplication among players at the same game, each card printed should be different from each other card printed for a given "lot" of cards, which may typically be 6,000 cards, 9,000 cards or 18,000 cards.

After the sheets have been printed, they are collated to produce a book which may, for example, have 20 pages. Conventional techniques make each page a different colour so that the different kinds of bingo games can be colour-coded. The use of different colours requires extra handling and costs.

After the large sheets of paper have been collated into stacks, they are cut into smaller sizes in a specific procedure. Then the individual pads of typically 5 to 30 pages long require gluing along one edge. This is normally done by hand.

It will thus be appreciated that, in the conventional procedure utilizing offset printing, the photographic techniques require a master printing plate for each large-sized sheet. This means that a large number of plates are required, and these plates must be protected and maintained, as well as being stored. Because many types of bingo are being played currently, again many master printing plates are required for each type.

A further disadvantage relating to the conventional technique is the necessity of purchasing and maintaining expensive printing and handling equipment. In addition, a large building space is required not only for the printing equipment, but for the storage of materials, including the plates.

Because a central printing source is required in order to maintain low equipment costs, the result is high shipping and freight costs, as well as scheduling problems.

Naturally, adequate numbers of well trained and highly labour-intensive staff are required to do all of the above work.

The conventional system does not have the flexibility for quickly inserting advertising material into the pads, which could be a source of revenue, nor is there any flexibility for format variety. Once the plates are prepared, they absolutely determine the nature of the end product.

There is further no flexibility for language considerations, for example French, English, Spanish, Chinese, Arabic and other options.

Finally, the conventional method requires a high inventory of bingo card sheets to be kept in storage.

U.S. Pat. No. 4,448,127, issued May 15, 1984 to Frain, is typical of the prior art.

Two other prior patents of interest are U.S. Pat. No. 4,270,774, issued June 2, 1981 to G. W. Barnes, and U.S. Pat. No. 4,398,708, issued Aug. 16, 1983 to M. Goldman et al. Barnes is representative of the prior art, by reason of using an endless-loop belt press which accommodates a large number of pre-established printing plates which presumably are such as to avoid bingo card duplication. Barnes does not actually select the configurations. In view of the use by Barnes of an endless-loop belt press in one pass (a complete circulation of the belt), his method cannot be linked to a computer-controlled method either explicitly or implicitly. It is clear that Barnes operates on the assumption that previously selected card combinations will already be available.

Goldman, by contrast, does not describe or discuss any methodology for producing bingo cards. Essentially, Goldman uses a computer to control the selection of alphanumeric configurations of a specific number for a lottery ticket, and the printing of that number. While it is true that Goldman mentions bingo cards in his disclosure, it is clear that Goldman regards bingo cards merely as a substrate on which his lottery numbers can be printed, without interfering with the use of the card for playing bingo. In other words, the lottery idea is additional to the use of the card as a bingo card. Goldman employs a single or double algorithm (a kind of mathematical formula) into which he plugs each of a series of sequential numbers, these being the serial numbers which are shown at lower left in FIG. 1 of Goldman. The algorithm or algorithms then operate on each number in sequence, and produce from each number a lottery number which is then printed in the upper right-hand corner of the ticket. Because of the nature of the algorithms, there is a false impression of randomness in the resulting lottery numbers, such that the casual observer would not be able to detect the sequence or system by which the lottery numbers are generated from sequential serial numbers. It is important to realize, however, that the process of Goldman is not a random one. One of the purposes behind the Goldman procedure is to allow a cross-check on a ticket presented as a winning ticket, to ensure that the ticket holder has not printed the ticket himself, or altered another ticket (for example, by changing a 3 to an 8, etc.) This is done at the time of presentation of the winning ticket by inputting the serial number of the ticket into a computer programmed with the same algorithm or algorithms that were originally used. If the resultant number is the same as the lottery number that appears on the ticket, then one can be sure that the lottery ticket is genuine. Thus, it is clear that Goldman does not use true randomness for his lottery number, since then it would not be possible to carry out the cross-check just explained.

GENERAL DESCRIPTION OF THIS INVENTION

In view of the substantial drawbacks of the conventional method described above, it is an aim of an aspect of this invention to provide an improved method of making bingo cards, which does not require manual permutation formulations, printing plates, large working area, large storage capacity or large numbers of well-trained staff.

It is an aim of another aspect of this invention to provide a method of making bingo cards which has complete flexibility in terms of advertising capability, varying the format, creating new game types, utilizing different languages, setting up new decentralized manufacturing facilities, creating local employment and exporting the inventive concept.

It is an aim of another aspect of this invention to eliminate the necessity to keep a high inventory of bingo cards and plates in storage, and the requirement for a large building space and large working area.

It is an aim of yet another aspect of this invention to permit a much greater permutation base, which may be 36,000 or even 72,000 cards.

More particularly, this invention provides a method of making bingo cards, comprising the steps:

providing a computer having a memory, a random number generating capability and a comparator capability, producing number combinations for a plurality of bingo cards on the basis of random numbers generated by the random number generating capability of the computer, storing said number combinations in an electronic or magnetic memory, employing the comparator capability of the computer to eliminate duplication from among said stored number combinations, and using a computer-controlled, high-speed graphics printer to print, on sheets of paper, bingo cards having the said number combinations.

In a preferred embodiment, this invention provides an apparatus for making bingo cards, comprising:

computer-controllable, high-speed graphics printing means, means including a random number generator for formatting the number combination of a new bingo card, memory means for storing formatted number combinations, comparator means for comparing each newly formatted number combination with all number combinations previously stored in the memory means, and for (a) rejecting a newly formatted number combination that is identical to a previously stored number combination, and (b) storing in the memory means a newly formatted number combination that is different from all previously stored number combinations, counting means for totalling all number combinations in the memory means, means responsive to the total count that, upon the count advancing by a given increment, causes the printing means to print on a sheet of fan-folded paper bingo cards corresponding to said increment.

GENERAL DESCRIPTION OF THE DRAWINGS

One embodiment of this invention is illustrated in the accompanying drawings, in which.

DETAILED DESCRIPTON OF THE DRAWINGS

Figure 1:
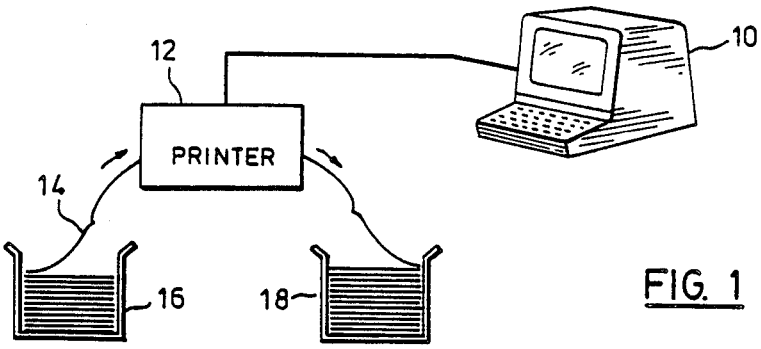
FIG. 1 is a schematic view of the computer controlled printing system of this invention.

In FIG. 1, a computer 10 is programmed to allow it to produce a large number of different specific bingo game cards using the letters B, I, N, G and O and permutations of the numbers of 1 to 75. Alternatively, the computer 10 could select cards or patterns using more numbers than 75, as required in certain variations of the bingo game. The computer 10 could also be programmed with advertising and information regarding the different kinds of bingo games to be played.

Out of the large number of possible permutations for various cards, the computer controls the appropriate selection of cards and controls a high-speed graphics printer 12, for example a laser printer, to which fan-folded paper 14 is fed from a first box 16. The fan-folded paper, after printing by the laser printer 12, is again folded up in a second box 18.

Alternatively, telephone lines or satellites could be used to transmit data from the computer to remote graphics printers in fixed or mobile stations.

The printer 12 is enabled to print not only the bingo cards, for example 6 or 12 per sheet, but also pertinent advertising and information regarding the games to be played. The sequential sheets of the fan-folded paper 14 are printed according to a predetermined format for specific types of bingo games.

If desired, the fan-folded, printed paper in the second box 18 can be cut into smaller sizes, either before or after separating into "books" of bingo cards.

It will be appreciated that the fan-folded, printed paper could be separated into individual sheets sold separately to the bingo players, for example with 1 to 12 or more bingo cards per sheet, or could be divided into books or pads of a given number of sheets, these containing the cards to be played in a given evening.

Figure 2:
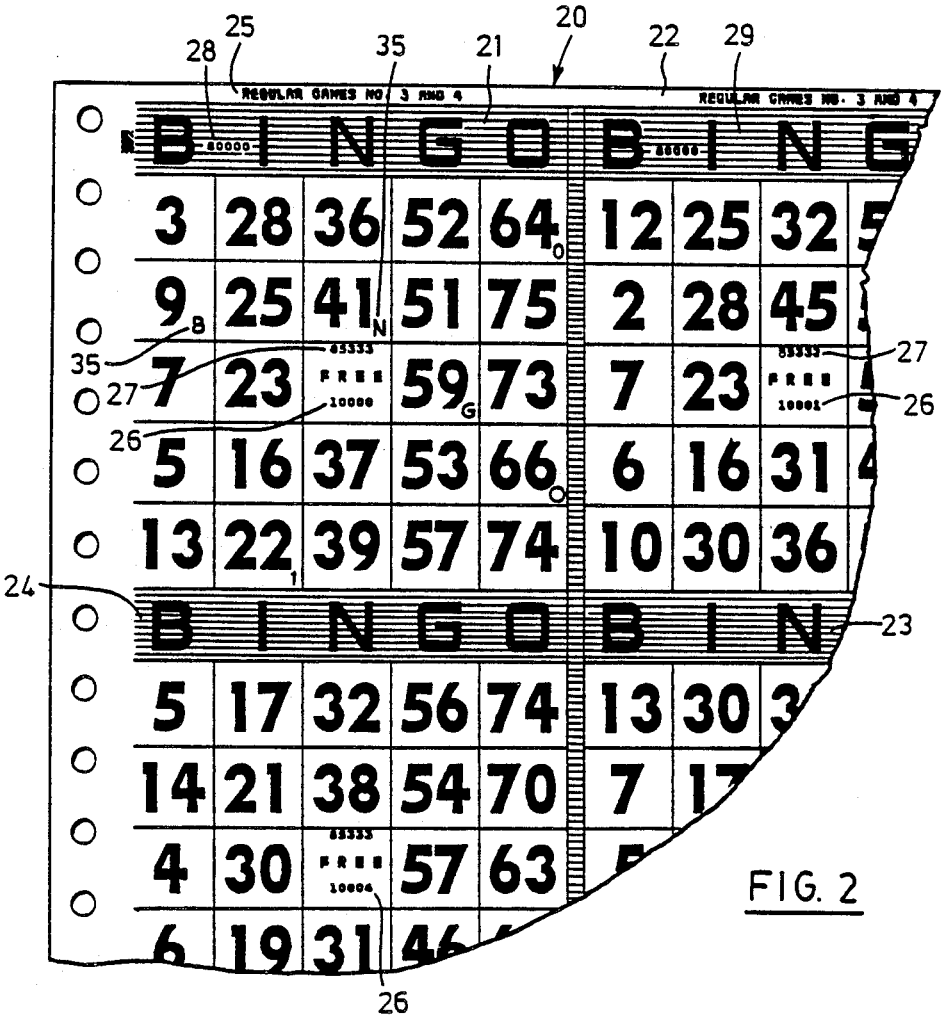
FIG. 2 shows a portion of a sheet printed in accordance with this invention.

Attention is now directed to FIG. 2, which shows a portion of one printed sheet 20 containing a number of printed bingo cards 21, 22, 23 and 24. It will be noted that each bingo card is identified by a different number 26 appearing in the centre square, this being the numeral identifying the particular permutation. The cards could also be printed with a different number 28 identifying the book to which the cards belong, and additional information could also be provided, for example the game type and/or game number 25.

In FIG. 2, the numeral 27 is a batch number, and identifies the date or customer purchase order.

It is not necessary to print in various colours, particularly in view of the fact that the graphics printer can apply shaded patterns behind certain areas, to help the customer identify different games, or different cards to be played. An example of such shading occurs at the numeral 29 in FIG. 2, in which the background of the word "BINGO" has been shaded.

Sub-alphabetic or numeric characters 35 can be printed in randomly selected squares on the bingo cards, to facilitate the playing of special kinds of bingo games.

Figure 3:
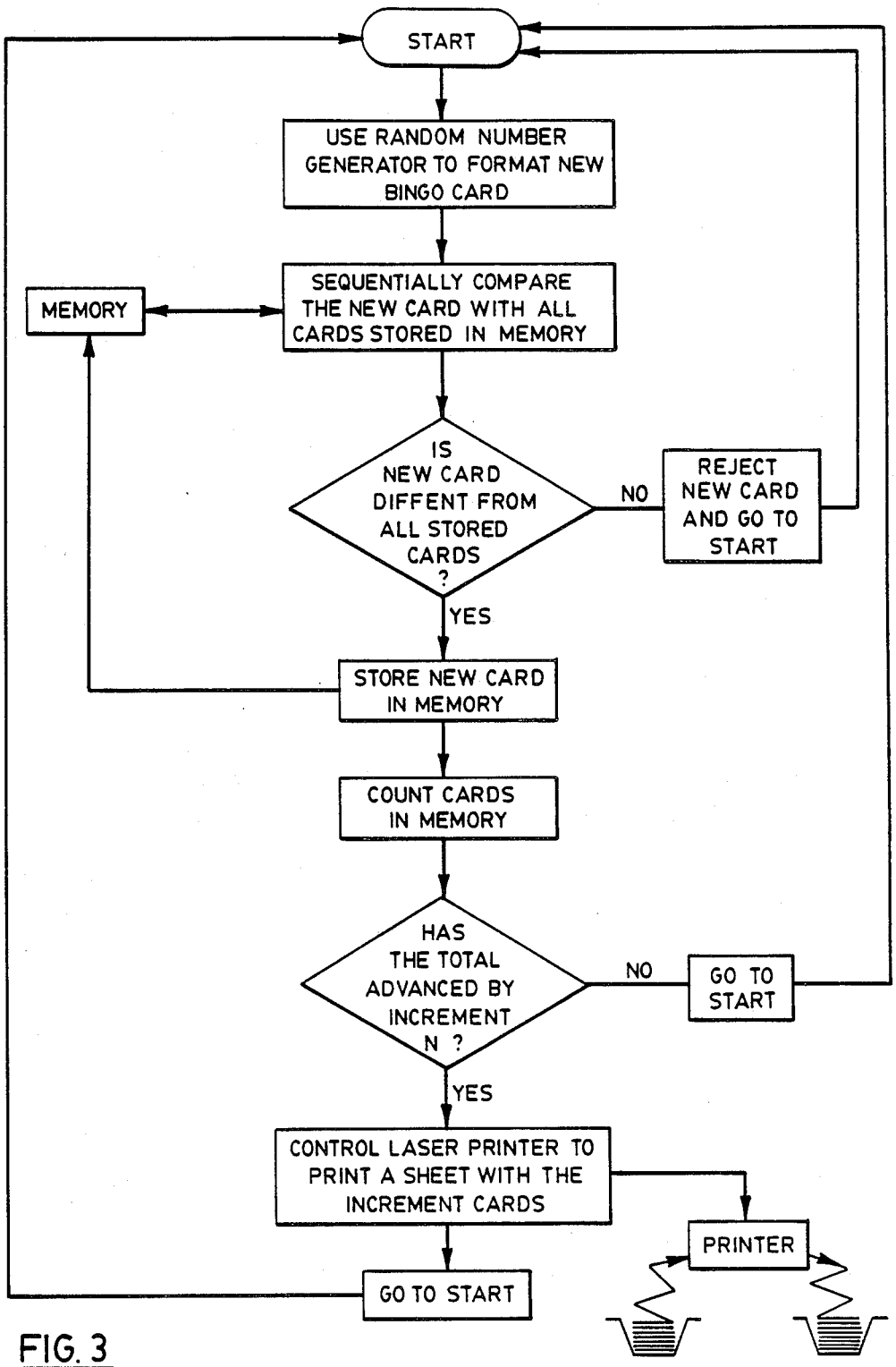
FIG. 3 is a flow sheet showing the steps followed by the computer program.

Attention is now directed to FIG. 3, which is a flow sheet showing the logical sequence followed by the computer program.

The computer first uses an internal random number generating means as the basis for formatting the number combination of a new bingo card, whereupon the new number combination is compared sequentially with all number combinations previously stored in the computer memory. This may be referred to as "comparator means". The computer rejects the new number combination if it is the same as a stored number combination, and returns to the start of the program, to generate a new number combination. However, if the new number combination is different from all previously stored number combinations, then the new number combination is stored in the memory.

The computer carries out an on-going count of all number combinations in the memory, and when the total has advanced by a given number or increment, which may for example be 24, 36, or any number corresponding to the total number of bingo cards to be printed on a given sheet of fan-folded paper, the computer causes the graphics printer to print on the sheet of fan-folded paper all of the cards making up the increment by which the total is increased. After each number combination is stored in memory, the computer proceeds to generate a new number combination.

The flow sheet of FIG. 3 does not include the steps involving the printing of advertising material and other indicia on the sheets.

In the claims which follow, the printer or printing means is described as a computer-controllable, high-speed graphics printer. At the present time, the most widely used printer in this category is a laser printer. However, other computer-controllable, high-speed graphics printers are currently being developed, such as those based on the principle of ion deposition, and it will be understood that all printers capable of graphics printing at high speed under the control of a computer would function well with this invention.

While one embodiment of this invention has been described hereinabove and illustrated in the accompanying drawings, it will be evident to those skilled in the art that changes and modifications may be made therein without departing from the essence of this invention, as set forth in the appended claims.

The embodiments of the invention in which an exclusive property or privilege is claimed are defined as follows:

1. A method of making bingo cards, comprising the steps:

providing a computer having a memory, a random number generating capability and a comparator capability, producing number combinations for a plurality of bingo cards on the basis of random numbers generated by the random number generating capability of the computer, storing said number combinations in an electronic or magnetic memory, employing the comparator capability of the computer to eliminate duplication from among said stored number combinations, and using a computer-controlled, high-speed graphics printer to print, on sheets of paper, bingo cards having the said number combinations.

2. The method claimed in claim 1, in which the printer is a laser printer, and in which the said computer controls the laser printer, the paper sheets being fan-folded, interconnected sheets.

3. The method claimed in claim 2, in which there are between one and twelve different bingo cards on each sheet of said fan-folded paper.

4. The method claimed in claim 2, in which the fan-folded paper feeds out of a first box, through the laser printer, and back into a second box in fan-folded condition.

5. The method claimed in claim 2, in which the computer carries out the steps of:

(a) producing the number combination of a bingo card using said random number generating capability, (b) comparing the new number combination sequentially with all number combinations previously stored in its memory, (c) rejecting the new number combination if it is the same as a stored number combination, and returning to (a), (d) storing the new number combination in memory if it is different from all previously stored number combinations, (e) counting the number combinations in memory and when the total has advanced by a given number (f) causing the laser printer to print bingo cards corresponding to said given number, (g) returning to (a) after each number combination is stored in memory.

6. The method claimed in claim 1, in which the paper is a recycled paper adapted to accept water-based inks.

7. An apparatus for making bingo cards, comprising:

computer-controllable, high-speed graphics printing means, means including a random number generator for formatting the number combination of a new bingo card, memory means for storing formatted number combinations, comparator means for comparing each newly formatted number combination with all number combinations previously stored in the memory means, and for (a) rejecting a newly formatted number combination that is identical to a previously stored number combination, and (b) storing in the memory means a newly formatted number combination that is different from all previously stored number combinations, counting means for totalling all number combinations in the memory means, means responsive to the total count that, upon the count advancing by a given increment, causes the printing means to print on a sheet of fan-folded paper bingo cards corresponding to said increment.

* * * * *